US006832744B1

(12) United States Patent
Pitt

(10) Patent No.: US 6,832,744 B1
(45) Date of Patent: Dec. 21, 2004

(54) VISUAL SIGNALLING DEVICE FOR SERVICE

(76) Inventor: David M. Pitt, 76 Stewart St., Rochester, NY (US) 14620

( * ) Notice: Subject to any disclaimer, the term of this patent is extended or adjusted under 35 U.S.C. 154(b) by 0 days.

(21) Appl. No.: 10/651,794

(22) Filed: Aug. 29, 2003

Related U.S. Application Data

(60) Provisional application No. 60/406,598, filed on Aug. 29, 2002.

(51) Int. Cl.[7] ..... A47G 23/02

(52) U.S. Cl. ..... 248/146; 248/148

(58) Field of Search ..... 248/146–153, 248/444, 441.1, 450, 454, 455, 456, 446; 211/74

(56) References Cited

U.S. PATENT DOCUMENTS

| | | | | | |
|---|---|---|---|---|---|
| 1,070,295 | A | * | 8/1913 | Shea | 248/146 |
| D45,362 | S | * | 3/1914 | Woodside | D7/313 |
| 1,228,473 | A | * | 6/1917 | Panay | 16/305 |
| 1,597,548 | A | * | 8/1926 | Sharp | 211/74 |
| 1,633,083 | A | * | 6/1927 | Fite, Jr. | 248/105 |
| 1,749,696 | A | * | 3/1930 | Duke | 206/45.24 |
| D186,195 | S | * | 9/1959 | Cole | D32/53.1 |
| 3,818,293 | A | * | 6/1974 | Wood et al. | 318/139 |
| D297,676 | S | * | 9/1988 | Ross et al. | D32/53.1 |
| 5,022,616 | A | * | 6/1991 | Kordecki | 248/106 |
| D349,376 | S | * | 8/1994 | Hankey, Sr. | D32/53.1 |
| 5,472,098 | A | * | 12/1995 | Ho | 211/2 |
| 5,624,043 | A | * | 4/1997 | Baptista | 211/74 |
| 5,950,831 | A | * | 9/1999 | Millet | 206/446 |
| 6,425,421 | B1 | * | 7/2002 | Morrison | 141/64 |
| 6,431,392 | B1 | * | 8/2002 | Eisenbeisz | 220/759 |

FOREIGN PATENT DOCUMENTS

| | | | | |
|---|---|---|---|---|
| DE | 41 35 925 | * | 5/1993 | F25D/3/06 |
| FR | 2 610 810 | * | 2/1987 | A47G/23/02 |

* cited by examiner

*Primary Examiner*—Anita King
*Assistant Examiner*—Amy J. Sterling
(74) *Attorney, Agent, or Firm*—Robert J. Bird

(57) ABSTRACT

A visual signalling device, by which to signal for service, includes an elongated cradle with upper and lower ends, the upper end standing on legs to thereby incline the cradle at a tilt angle. The cradle includes a bottom, sidewalls, and a lower endwall. The legs are tapered from top to bottom. The bottom of the cradle is apertured at the tops of the legs to permit stacking of these devices atop on another. The tilt angle is in the range of 25° to 65° from vertical, preferably about 50°. The sidewalls include one or more notch receptacles for money. The device is thus adapted to hold a container such, as an empty beer bottle, at a tilt angle as a visual signal for service.

4 Claims, 2 Drawing Sheets

VISUAL SIGNALLING DEVICE FOR SERVICE

CROSS-REFERENCE TO RELATED APPLICATION

This application relates to my copending Provisional Patent Applicaton No. 60/406,598 which was filed on Aug. 29, 2002. That filing date is claimed for this application.

BACKGROUND OF THE INVENTION

The invention is a visual signaling device for alerting a bartender or serving person that a patron wishes attention, specifically for beverage service.

A bartender typically services a number of patrons, and if there are many patrons, it may be difficult for a patron to get the bartender's attention when the patron wants another drink, for example a bottle of beer. An empty bottle stands up straight, just like a full bottle; and beer bottles are usually brown or green, so it is not readily apparent from a distance or at a glance that a bottle is full, half full, or empty (especially in a restaurant or bar with subdued lighting). In short, an empty bottle may not readily catch the eye of a busy bartender.

It may be difficult for the server to discreetly notice a patrons's need. It is necessary for the server and patron to make contact, but preferably without frequent calls from one to the other.

To simplify communication from patrons to server, it will be useful to have a simple signalling device to make discreet contact from a distance.

SUMMARY OF THE INVENTION

In summary, this invention is a visual signalling device by which to signal for service. It includes an elongated cradle with upper and lower ends, the upper end standing on legs to thereby incline the cradle at a tilt angle. The cradle includs a bottom, sidewalls, and a lower endwall. The legs are tapered from top to bottom. The bottom of the cradle is apertured at the tops of the legs to permit stacking of these devices atop on another. The tilt angle is in the range of 25° to 65° from vertical, preferably about 50°. The sidewalls include one or more notch receptacles for money. The device is thus adapted to hold a container such, as an empty beer bottle, at a tilt angle as a visual signal for service.

DRAWING

DETAILED DESCRIPTION

Figure 1:
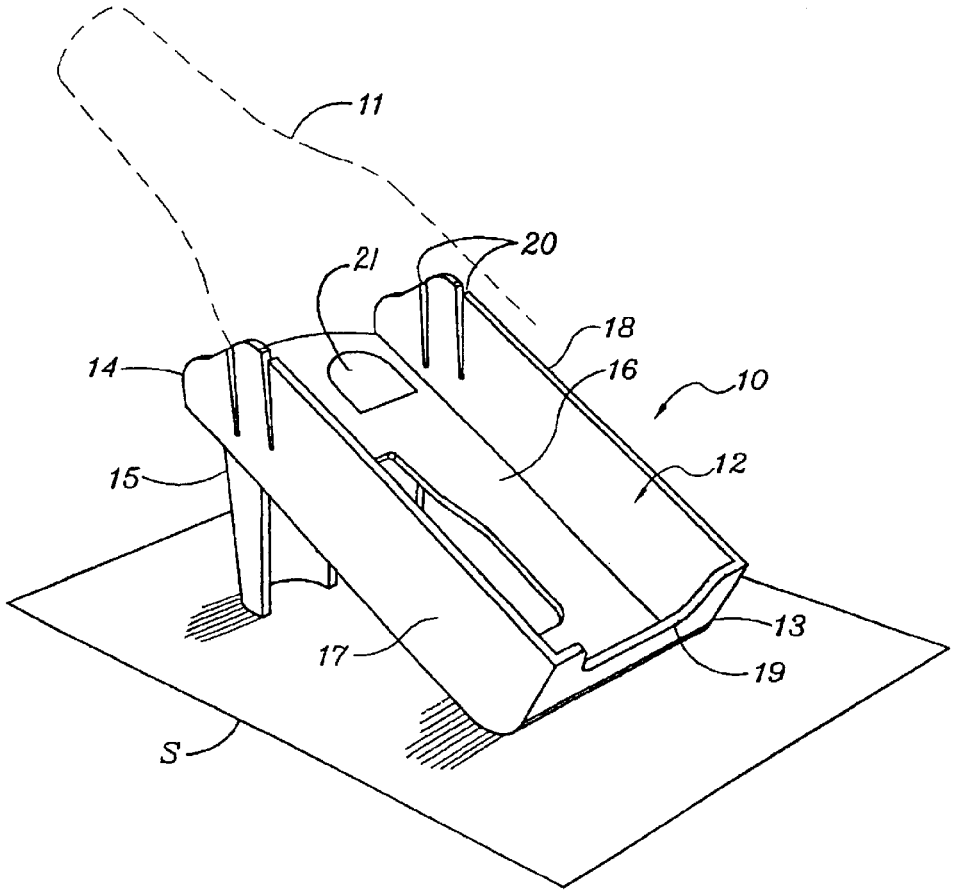
FIG. 1 is a perspective view of my signalling device.
Figure 2:
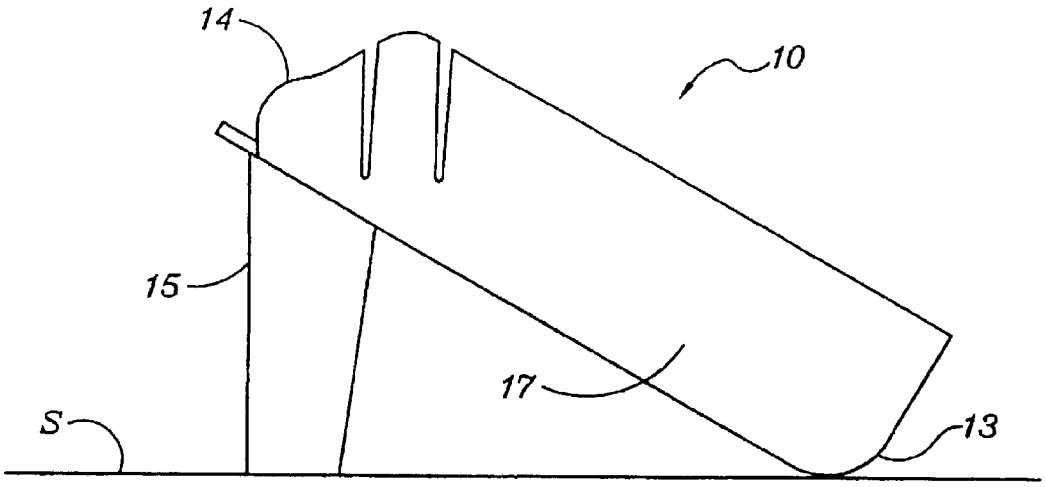
FIG. 2 is a side view of the signaling device of FIG. 1.

Referring to the drawing, my signaling device 10 is a prop or support on which to place an empty container 11 (bottle, can, or glass) as a visual signal to the bartender. The empty container 11 catches the eye because it is tilted at an angle by the device 10.

The signalling device 10 includes an elongated frame or cradle 12 with ends 13, 14. The lower end 13 rests directly on a supporting surface S, such as a bar or tabletop. The upper end 14 is on legs 15 which stand on the surface S. The cradle 12 is thus inclined at a tilt angle relative to the supporting surface S. The cradle 12 includes a bottom 16, sidewalls 17, 18, and a lower endwall 19. The upper end 14 of the cradle 12 is open The sidewalls 17, 18 include vertical notch receptacles 20 for convenient placement of paper money for the server.

Figure 3:
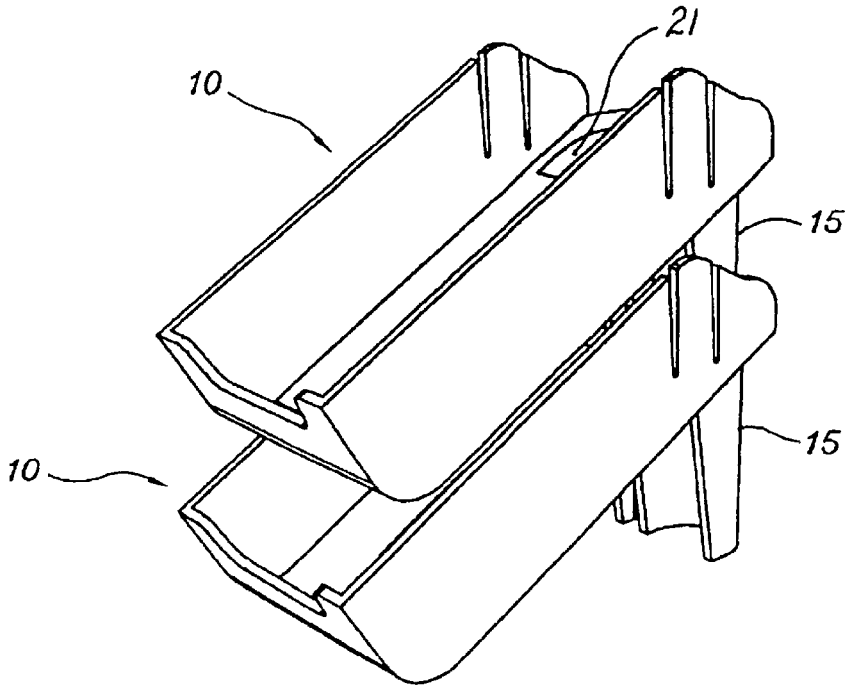
FIG. 3 is a perspective view showing two of my signalling devices stacked.

The legs 15 are channeled or otherwise hollow, and slightly tapered from top to bottom. The frame bottom 16 includes apertures 21 opening into the leg channels, whereby the devices 10 are stackable, one upon another, as shown in FIG. 3.

The sidewalls 17, 18 of this device provide a convenient location for an advertiser's logo, or the like.

The presently preferred tilt angle of my device is shown as approximately 50° from the vertical. A range of angles from about 25° to about 65° from the vertical are within the scope of this invention.

The container 11 is shown as a bottle, but my signalling device 10 is intended for use also with cans, tumblers, and the like.

Any terms indicative of orientation are used with reference to drawing illustrations. Such terms are not intended as limitations but as descriptive words. Apparatus described herein retains its described character whether it be oriented as shown or otherwise.

The foregoing description of a preferred embodiment of this invention sets forth the best mode presently contemplated by the inventor of carrying out this invention. Any details as to materials, quantities, dimensions, and the like are intended as illustrative. The concept and scope of the invention are limited not by the description but only by the following claims and equivalents thereof.

What is claimed is:

1. A visual signalling device by which to signal for service, including:

a cradle with upper and lower ends, said upper end including a depending leg to elevate said upper end relative to said lower end to thereby incline said cradle at a tilt angle relative to a supporting surface;

said cradle including a bottom, sidewalls along said bottom, and a lower endwall;

said leg being tapered from top to bottom thereof;

whereby said cradle is adapted to hold an empty container at a tilt angle as a visual signal for service;

said bottom of said cradle being apertured adjacent to the top of said leg to permit stacking of a plurality of said devices.

2. A signalling device as defined in claim 1, wherein said sidewalls include one or more notch receptacles to hold money therein.

3. A visual signalling device by which to signal for service, including:

an elongated cradle with upper and lower ends, said upper end including depending legs to elevate said upper end relative to said lower end to thereby incline said cradle at a tilt angle relative to a supporting surface;

said cradle including a bottom, sidewalls along said bottom, and a lower endwall;

said legs being tapered from top to bottom thereof;

whereby said cradle is adapted to hold an empty container at a tilt angle as a visual signal for service;

said bottom of said cradle being apertured adjacent to the tops of said legs to permit stacking of a plurality of said devices.

4. A signalling device as defined in claim 3, wherein said sidewalls include one or more notch receptacles to hold money therein.

* * * * *